United States Patent [19]

Feathers

[11] 4,337,766

[45] Jul. 6, 1982

[54] VALVES

[75] Inventor: Leonard J. Feathers, Sussex, England

[73] Assignee: Chubb Panorama Limited, Bognor Regis, England

[21] Appl. No.: 151,866

[22] Filed: May 21, 1980 (Under 37 CFR 1.47)

[51] Int. Cl.[3] ..... A62B 7/04

[52] U.S. Cl. ..... 128/204.26; 137/494; 137/DIG. 9; 137/505.41

[58] Field of Search ..... 128/204.26, 204.27, 128/204.28; 137/494, DIG. 9, 505.41, 505.42

[56] References Cited

U.S. PATENT DOCUMENTS

| | | | |
|---|---|---|---|
| 2,949,113 | 8/1960 | Bisset | 128/204.26 |
| 3,357,447 | 12/1967 | Zarichansky | 128/204.26 |
| 3,716,053 | 2/1973 | Almovist et al. | 128/204.26 |
| 3,857,407 | 12/1974 | Olson | 137/505.41 |
| 4,172,467 | 10/1979 | Warnow | 137/494 |

FOREIGN PATENT DOCUMENTS

| | | | |
|---|---|---|---|
| 24714 | 4/1959 | German Democratic Rep. | 137/DIG. 9 |
| 456066 | 10/1936 | United Kingdom | 128/204.26 |

*Primary Examiner*—Henry J. Recla

*Attorney, Agent, or Firm*—Pollock, Vande Sande & Priddy

[57] ABSTRACT

A tilt valve incorporated in a demand regulator for breathing apparatus has a head which seats over an opening through which the valve stem extends for operation by a pressure-responsive diaphragm. This opening defines the outlet port of a chamber wherein the valve head is disposed, the inlet port of the chamber opening to the same side of the valve head as the outlet port. Gas flowing from the inlet port to the outlet port therefore need not pass between the periphery of the valve head and the surrounding wall of the chamber, so that the head can be a close fit in the chamber to ensure a consistent seating of the head over the valved port.

4 Claims, 3 Drawing Figures

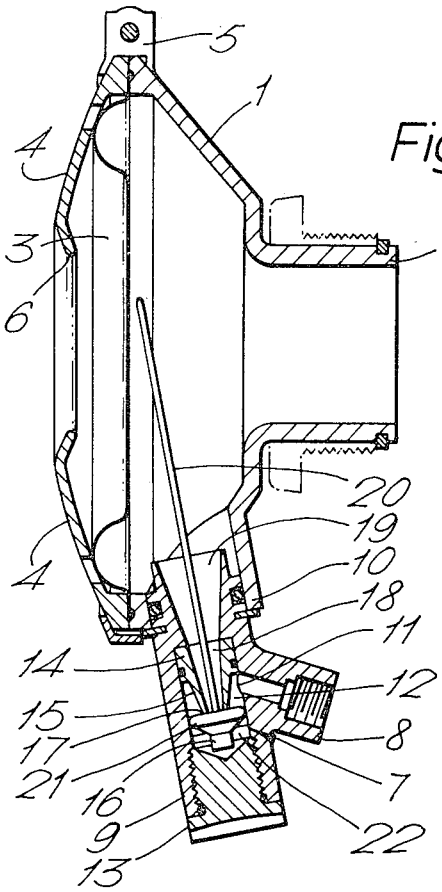
Fig.2.
Fig.3.
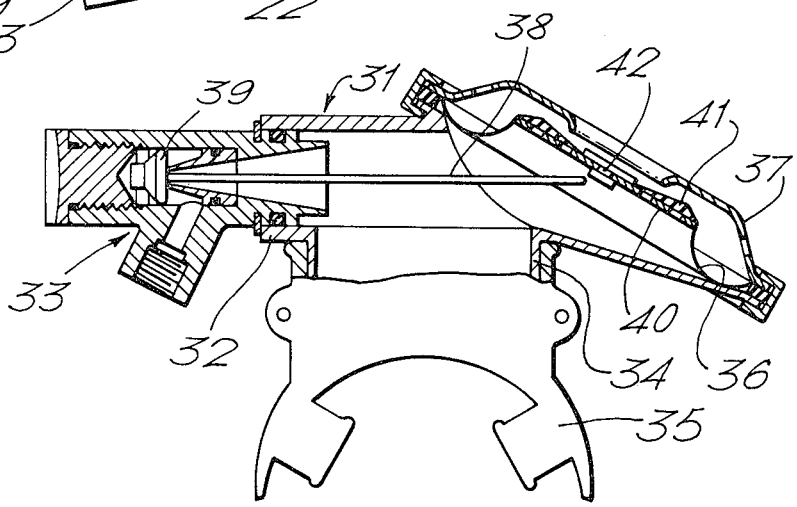

VALVES

The present invention relates to tilt valves. By a "tilt valve" is meant a valve of the kind in which there is a chamber having an inlet port and an outlet port, a valve head within the chamber adapted to seat over one of the ports to close that port to fluid flow, and a stem extending from the valve head whereby tilting of the stem tilts the head away from its seating so as to open the valved port to fluid flow.

Tilt valves can be utilized in breathing apparatus as disclosed for example in United Kingdom patent specifications Nos. 775.314 and 969.280 and in German patent specifications Nos. 1131998, 1139387 and 1185065, for regulating the supply of breathing gas to a user in accordance with his breathing demands. In such cases the valve is used in conjunction with a flexible diaphragm that responds to inhalation by the person using the apparatus to tilt the stem of the valve transitorily and thereby allow enough breathing gas to be supplied via the valve to satisfy the breathing need. In each of the tilt valves disclosed in United Kingdom patent specifications Nos. 775.314 and 969.280 and German patent specifications Nos. 1139387 and 1185065 the valve head is located to seat over the outlet port of a chamber provided in a hollow spigot which provides, at its inlet end, a union for connection to the supply of breathing gas. The spigot opens at its outlet end into a casing that contains the diaphragm, and the stem of the valve extends from the head through the outlet port (with clearance) to respond to deflection of the diaphragm upon each inhalation. The arrangement in German patent specification No. 1131998 is generally similar except that in this case the valve head is spring-urged within the chamber so as to seat over the inlet port rather than over the outlet port.

Tilt valves such as those discussed above operate in general quite successfully, but have certain practical disadvantages. In particular, with a tilt valve such as disclosed in United Kingdom patent specification No. 775314 the valve head is free for a small degree of lateral movement across the width of the valve chamber; such freedom is inherent in the necessity to maintain a gap of sufficient size between the periphery of the valve head and the surrounding wall of the chamber to pass gas through the chamber from its inlet port to its outlet port at the required rate when the valve is opened. Accordingly a fixed and consistent seating position of the head over the valved port cannot be assured and multiple ringing (grooving) of the face of the head—caused by the different impressions of the seating made in the face under different lateral positionings of the head over the port—is likely to occur. Such multiple ringing leads to undesirable leakage through the valve.

In order to reduce the incidence of leakage from ringing of the valve head in a tilt valve for use in high pressure systems, United Kingdom patent specification No. 949222 teaches the use of a valve spring arranged to exert a centering action on the valve head and to press the head against its seating in the same lateral position after each tilting of the head. However, a spring can provide only a resilient restraint and, being necessarily normally light in its action (particularly in the case where the valve is incorporated in a demand regulator for breathing apparatus), cannot in general overcome the problem entirely satisfactorily. Furthermore the provision of a spring is desirably to be avoided in the interests of simplicity.

The problem of multiple ringing of the valve head in a valve such as disclosed in United Kingdom patent specification No. 775314 could be overcome if the valve head was provided as a close fit in the chamber but such an arrangement conflicts with the need to provide a gas pathway of sufficient size around the periphery of the head. German patent specifications Nos. 1131998, 1139387 and 1185065 each disclose a form of tilt valve in which the head fits closely within its chamber but has notches in its periphery to provide for gas flow past the head when the valve is opened. With valves of this form, however, problems arise in providing notches of a sufficient size to pass adequate gas flows and the manufacture of the head is inevitably complicated. In practice uncontrollable pressure losses are experienced with such valves due to the abrupt changes in flow direction and available flow area encountered by the gas as it passes the head.

It is an aim of the present invention to provide a form of construction for a tilt valve which can be utilized to reduce the above-discussed problems.

Accordingly, in a first aspect the invention resides in a valve comprising a chamber having an inlet port and an outlet port, a valve head within the chamber adapted to seat over one of the ports to close that port to fluid flow, and a stem extending from the valve head whereby tilting of the stem tilts the head away from its seating so as to open said one port to fluid flow; wherein the other of the ports opens to the chamber at a location to the same side of the valve head as said one port, so that when the stem is tilted fluid can flow through the chamber from the inlet port to the outlet port without passing around the periphery of the head.

By providing a flow path for the fluid which avoids passage around the periphery of the head in a tilt valve according to the invention, the head of the valve can be provided as a close fit within the chamber if desired, to ensure that lateral movement of the head is positively limited so as to maintain it in a substantially consistent seating over the valved port. The problem of multiple ringing of the head thereby can be avoided. Furthermore the avoidance of a flow path which involves passage around the periphery of the head can lead to an improvement in the flow characteristics of the valve in comparison with prior art forms of tilt valve.

In a preferred embodiment of a tilt valve in accordance with the invention the valve head is adapted to seat over the outlet port of the chamber. This form has the advantage that if the fluid pressure which is applied to the inlet port of the chamber is transmitted to a space within the chamber to the opposite side of the valve head to the location of the ports such pressure can maintain the head upon its seating when the valve is closed, without the use of a valve spring. Such pressure transmission can be achieved by providing only a small gap between the periphery of the head and the surrounding wall of the chamber—this gap being much smaller than that which would be required to pass the full flow of fluid through the valve and permitting no substantial lateral movement of the head.

A valve as defined above may be constructed with a housing having a cylindrical bore closed at one end, an insert located in the bore and having a frusto-conical projection directed axially towards said closed end, the aforesaid chamber being defined within the bore of the housing between said insert and closed end, the insert having an axial bore opening through the apex of its said projection to define said outlet port over which the valve head is adapted to seat, and the inlet port opening through the wall of said cylindrical bore at a location between the base and apex of said projection.

The tilt valve of the invention is especially useful as part of a demand regulator for breathing apparatus and in a second aspect the invention resides in such a regulator comprising a valve according to the first-defined aspect of the invention of which the outlet port leads to a second chamber for communication with a face mask, mouthpiece or other breathing interface means; and comprising means responsive to the difference between the pressure within the second chamber and the ambient pressure, said pressure-responsive means being adapted to react, in use, to inhalation by the user of the apparatus to tilt the stem of the valve and thereby permit the flow of breathing gas through the valve to the user.

The invention also resides, in a third aspect, in breathing apparatus comprising a source of pressurized breathing gas, a demand regulator according to the second-defined aspect of the invention of which the inlet port is communicable with said gas source, and breathing interface means for communication with said second chamber of the demand regulator.

The invention will now be more particularly described, by way of example, with reference to the accompanying drawings, in which:

FIG. 2 is a sectional side elevation of the regulator of FIG. 1; and

FIG. 3 is a sectional plan view of a second demand regulator including a tilt valve in accordance with the invention, designed particularly for underwater use.

Figure 1:
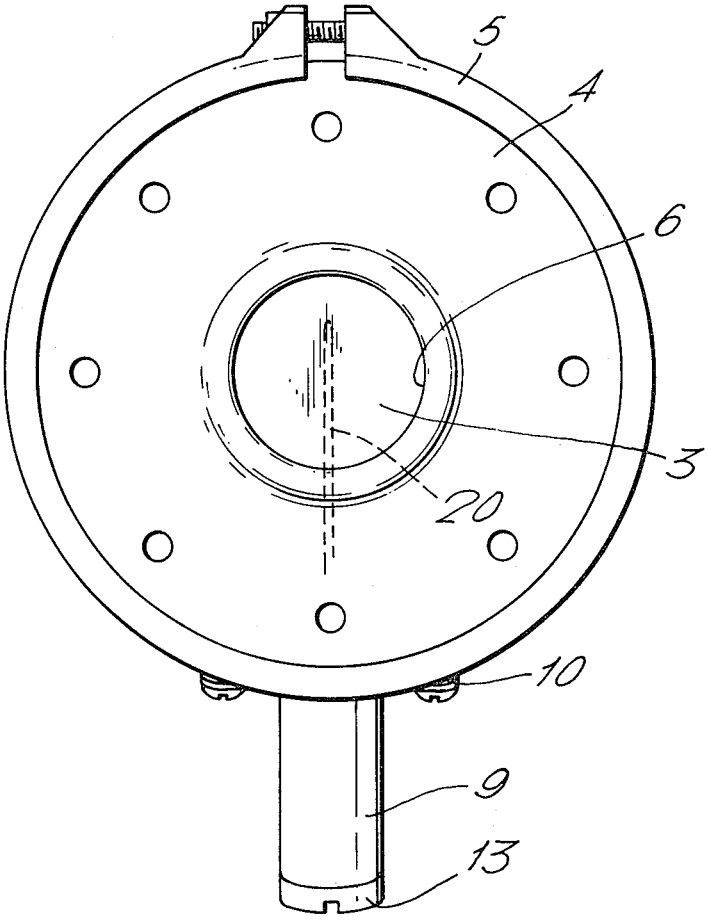
FIG. 1 is a front elevation of a demand regulator for use in breathing apparatus and which includes a tilt valve in accordance with the invention.

Referring to FIGS. 1 and 2, the demand regulator illustrated therein has a plastics casing 1 that is of cup shape and opens at its base into a standard tubular connector 2 for coupling the device into the mask of a breathing apparatus. A diaphragm 3 of synthetic rubber extends across the mouth of the cup-shape casing 1 and is sandwiched around its peripheral margin between the rim of the casing 1 and the rim of a plastics cover 4. An encircling clamping ring 5 urges the cover 4 onto the casing 1 so as to establish and maintain a periperal gas-seal between the diaphragm 3 and the casing 1. The cover 4 is perforated, having in particular a large central aperture 6, so that the diaphragm 3 is exposed within the cover 4 to ambient atmospheric pressure. Reduction of pressure within the casing 1 accompanying each inhalation by the mask wearer during breathing, will accordingly deflect the diaphragm 3 inwardly of the casing 1.

Deflection of the diaphragm 3 inwardly of the casing 1 acts via a tilt valve 7 to regulate admission of breathing gas to the casing 1 and thence through the connector 2 into the mask. The gas, normally an air-oxygen mixture, is supplied from a source, normally a high-pressure bottle, that is coupled to the regulator via a hollow threaded spigot 8. The spigot 8 extends sideways from a cylindrical metal housing 9 of the tilt valve 7 that is coupled into the wall of the casing 1 via a rotatable gas-tight joint 10.

The spigot 8 opens within the housing 9 through an inlet port 11 into a cylindrical bore 12 that is closed at its end remote from the casing 1 by a screw plug 13. A metal insert 14, which is a gas-tight push-fit in the opposite end of the bore 12, has a hollow frusto-conical projection 15 that projects past the port 11 in the bore 12 to provide a seating for the head 16 of the tilt valve 7. The head 16 seats on the top rim of the projection 15 over the opening 17 of a frusto-conical bore 18 that extends through the insert 14. The progressively-widening outlet passageway provided from the outlet opening 17 by the bore 18 is continued from the bottom of the bore 12 in a frusto-conical bore 19 of the housing 9 that opens into the casing 1.

A metal stem 20 of the valve head 16 extends from the head 16 through the opening 17 and into the casing 1 to lie adjacent to the central region of the diaphragm 3. The pressure of gas supplied via the inlet port 11 to the closed valve chamber in the bore 12 urges the head 16 firmly onto its seating to block the outlet opening 17 while there is no deflection of the diaphragm 3. However each deflection of the diaphragm 3 inwardly of the casing 1 in response to inhalation within the mask tilts the stem 20. This tilts the head 16 away from the rim of the projection 15 allowing passage of gas from the valvechamber through the outlet opening 17 into the casing 1 to meet the breathing needs of the mask wearer.

The head 16 of the tilt valve 7 is a close fit within the bore 12 and has rounded edges 21 to enable it to be tilted easily against the wall of the bore in regulating flow through the outlet opening 17. The inlet port 11 is located to the same side of the head 16 as the opening 17 so gas admitted into the valve chamber provided by the bore 12 is not required to pass between the periphery of the head 16 and the surrounding wall of the valve chamber in order to reach the outlet opening 17. The head 16 can therefore be as close a fit in the bore 12 as desirable to ensure that it remains with the same seating throughout operation it being required to provide a clearance between these components sufficient only to permit the transmission of the inlet gas pressure to the closed space 22 on the opposite side of the head 16, (rather than admitting the full flow of gas which passes through the valve) to keep the valve head seated when the diaphragm 3 is undeflected. The head 16 is preferably a moulding of polytetrafluorethylene (but may be of nylon) to provide for self-lubricating, and therefore low-friction, rubbing on the wall of the bore 12 and also reduction in the likelihood of sticking of the valve under conditions of icing; the stem 20 of the valve may in these circumstances be simply a metal rod forced into the head-moulding and retained frictionally.

The demand regulator described may be coupled to a high-pressure gas bottle without the necessity for an intermediate (first stage) pressure-reducing valve upstream of the regulator. In this respect the divergent outlet passageway defined by the aligned frusto-conical bores 18 and 19 provides for a gradual expansion of the gas as it enters into the casing 1.

The central aperture 6 in the cover 4 is large enough to enable the mask wearer to insert a finger and push the diaphragm 3 inwardly for the purpose of opening the tilt valve 7 by way of testing or admission of extra volume of gas.

Turning now to FIG. 3, the regulator illustrated therein is designed particularly for use with self-contained underwater breathing apparatus and comprises a casing 31 having a lateral limb 32 to which is coupled a tilt valve 33 of identical construction to the valve 7 described above in relation to FIGS. 1 and 2. Description of the tilt valve will accordingly not be repeated in this respect. In the embodiment of FIG. 3 the central limb 34 of the casing 31 is coupled to a moulded mouthpiece 35 through which breathing gas passed from the tilt valve can be supplied to a diver and through which exhaled gas can be received back from the diver. The diaphragm 36 in this case is laterally offset from centerline of the casing and is sandwiched around its peripheral margin between the casing and a perforate cover 37. The diaphragm responds to the difference between the ambient water pressure within cover 37 and the gas pressure within casing 31 when the diver inhales, by deflecting and tilting the stem 38 and head 39 of the valve 33 to supply breathing gas in accordance with the needs of the driver, in the same manner as described above in relation to FIGS. 1 and 2. The diaphragm also incorporates an exhalation valve comprising a perforate plate 40 and an elastomeric flap 41 secured centrally together by a fastener 42, which opens to vent exhaled gas to the surrounding environment when the pressure produced within the casing 31 upon exhalation exceeds the ambient pressure by a predetermined value.

I claim:

1. Breathing apparatus comprising a source of pressurized breathing gas; breathing interface means; means defining a gas flowpath from said source to said interface means and including a demand regulator for controlling the flow of gas from the source to the interface means in accordance with the respiratory demands of a user of the apparatus, the regulator comprising means defining a first chamber, means defining an inlet port connected to said source and opening to said first chamber, means defining an outlet port opening to said first chamber and leading to said breathing interface means, a valve head disposed within said first chamber and closely surrounded at its periphery by the wall of said first chamber so as to maintain the head generally concentric therewith, means defining a seating for the valve head whereby in a first position the head seats over said outlet port to close that port to gas flow, an elongate stem rigidly secured at one end to the valve head and extending generally coaxially therewith through said outlet port with clearance relative to said outlet port sufficient to permit the rigidly interconnected assembly of said valve head and stem to perform angular tilting movement as a unit to tilt said valve upon its seating away from its said first position thereby to open said outlet port to gas flow, means defining a second chamber communicable with said first chamber through said outlet port, and means responsive to the pressure within said second chamber and adapted to flex inwardly of said second chamber in response to inhalation by a user of the apparatus, said stem extending away from said valve head and through said second chamber to be engageable at its other end by said pressure-responsive means such that said inward flexure of the pressure-responsive means displaces said other end of the stem to tilt said valve head away from its said first position as aforesaid directly through the agency of said stem, and said inlet port opening to said first chamber at a location which is to the same side of said valve head as said outlet port in the sense that when said valve head is tilted away from its said first position to open said outlet port as aforesaid gas can flow through said first chamber from said inlet port to said outlet port and thence to said breathing interface means without passing between the periphery of said valve head and the surrounding wall of said first chamber.

2. A gas flow control valve comprising means defining a first chamber; means defining an inlet port opening to said first chamber; meand defining an outlet port opening to said first chamber; a valve head disposed within said first chamber and closely surrounded at its periphery by the wall of said first chamber so as to maintain said valve head generally concentric therewith; means defining a seating for said valve head whereby said valve head is adapted to assume a seated position on said seating over said outlet port to close that port to gas flow; an elongate stem one end of which is rigidly secured to the valve head, said stem extending away from said valve head generally coaxially therewith and extending through said outlet port with clearance relative to said outlet port sufficient to permit said interconnected valve head and stem to perform angular tilting movement as a whole to tilt said valve head upon said seating away from its said seated position thereby to open said outlet port to gas flow; means defining a second chamber communicable with said first chamber through said outlet port; and pressure responsive means disposed adjacent the other end of said elongate stem, said pressure responsive means being responsive to the pressure within said second chamber and adapted to flex inwardly of said second chamber in response to reduction of gas pressure in said second chamber below a predetermined threshold pressure; said stem extending away from said valve head and through said second chamber to be engageable at its other end by said pressure-responsive means such that said inward flexure of said pressure-responsive means displaces said other end of the stem to tilt said valve head away from its said seated position as aforesaid directly through the agency of said stem; the inlet port opening to said first chamber at a location which is to the same side of said valve head as said outlet port in the sense that when said valve head is tilted away from its said seated position to open said outlet port as aforesaid gas can flow through said first chamber from the inlet port to the outlet port without passing between the periphery of said valve head and the surrounding wall of said first chamber.

3. A valve according to claim 2 comprising means for transmitting gas pressure applied to said inlet port to a space within said first chamber to the side of the valve head opposite from said ports, thereby tending to maintain the valve head upon its seating.

4. A valve according to claim 2 comprising: a housing having a cylindrical bore closed at one end; an insert located in the bore and having a frusto-conical projection directed axially towards said closed end; said first chamber being defined within the bore of the housing between said insert and closed end; the insert having an axial bore opening through the apex of its projection to define said outlet port over which the valve head is adapted to seat; and said inlet port opening through the wall of said cylindrical bore at a location between the base and apex of said projection.

* * * * *